US009076399B2

(12) United States Patent
Park

(10) Patent No.: US 9,076,399 B2
(45) Date of Patent: Jul. 7, 2015

(54) LIQUID CRYSTAL DISPLAY HAVING LEVEL SHIFTER

(71) Applicant: LG Display Co., Ltd., Seoul (KR)

(72) Inventor: Mingyu Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 169 days.

(21) Appl. No.: 13/848,883

(22) Filed: Mar. 22, 2013

(65) Prior Publication Data

US 2013/0249781 A1 Sep. 26, 2013

(30) Foreign Application Priority Data

Mar. 23, 2012 (KR) ..... 10-2012-0030091

(51) Int. Cl.
*G09G 3/36* (2006.01)

(52) U.S. Cl.
CPC ..... *G09G 3/3611* (2013.01); *G09G 3/3648* (2013.01); *G09G 3/3677* (2013.01); *G09G 3/3688* (2013.01); *G09G 2310/0289* (2013.01); *G09G 2330/026* (2013.01); *G09G 2370/08* (2013.01)

(58) Field of Classification Search
CPC ..... G09G 3/30; G09G 3/364; G09G 3/3648; G09G 3/3677; H03F 3/3066; H03K 19/01728; H03K 19/09448; H03K 19/0963
See application file for complete search history.

(56) References Cited

U.S. PATENT DOCUMENTS 5,206,634 A * 4/1993 Matsumoto et al. ..... 345/99
5,300,945 A * 4/1994 Iemoto et al. ..... 345/92
5,343,092 A * 8/1994 Dhong et al. ..... 326/126
6,542,144 B2 * 4/2003 Kogure et al. ..... 345/98
6,552,613 B2 * 4/2003 Murray et al. ..... 330/255
7,952,415 B2 * 5/2011 Shim ..... 327/333
8,390,556 B2 * 3/2013 Smith et al. ..... 345/98
8,786,349 B2 * 7/2014 Kimura ..... 327/310
8,786,538 B2 * 7/2014 Byun et al. ..... 345/100
2002/0075249 A1 6/2002 Kubota et al.
2003/0090614 A1 5/2003 Kim et al.
2004/0239655 A1 * 12/2004 Tani et al. ..... 345/204
2006/0176073 A1 * 8/2006 Chen et al. ..... 326/21

FOREIGN PATENT DOCUMENTS

CN 1323025 A 11/2001
CN 1561469 A 1/2005

OTHER PUBLICATIONS

SIPO: First Office Action for related Chinese Patent Application No. 201310093969.3 including English Translation—Issued on Dec. 3, 2014.
SIPO: First Office Action for related Chinese Patent Application No. 2013100939693 including English Translation— Issued on Dec. 3, 2014.

* cited by examiner

*Primary Examiner* — Alexander H Taningco
*Assistant Examiner* — Kurtis R Bahr
(74) *Attorney, Agent, or Firm* — Morgan, Lewis & Bockius LLP

(57) ABSTRACT

A level shifter for a liquid crystal display is disclosed. The level shifter includes a pull-down transistor which includes a source terminal, to which the gate low voltage is supplied, and a drain terminal connected to an output terminal of the level shifter, and discharges a voltage of an output terminal of the level shifter, and an output stabilization circuit which is connected to a gate terminal of the pull-down transistor, controls a gate voltage of the pull-down transistor in the process of a power-on sequence, and discharges an output voltage of the level shifter.

16 Claims, 8 Drawing Sheets

LIQUID CRYSTAL DISPLAY HAVING LEVEL SHIFTER

This application claims the benefit of Korean Patent Application No. 10-2012-0030091 filed on Mar. 23, 2012, the entire contents of which is incorporated herein by reference for all purposes as if fully set forth herein.

BACKGROUND OF THE INVENTION

1. Field of the Invention

Embodiments of the invention relate to a level shifter for a liquid crystal display.

2. Discussion of the Related Art

An active matrix liquid crystal display includes a thin film transistor (TFT) as a switching element in each pixel. The active matrix liquid crystal display may be manufactured to be smaller than a cathode ray tube (CRT) and thus may be applied to display units of portable information appliances, office equipments, computers, etc. Further, the active matrix liquid crystal display may be applied to televisions and thus is rapidly replacing the cathode ray tube.

The liquid crystal display includes a liquid crystal display panel, a backlight unit providing the liquid crystal display panel with light, a data driving circuit for supplying a data voltage to data lines of the liquid crystal display panel, a gate driving circuit for supplying a gate pulse (or scan pulse) to gate lines (or scan lines) of the liquid crystal display panel, a timing controller for controlling operation timings of the data driving circuit and the gate driving circuit, etc. The liquid crystal display further includes a power supply device for generating the data voltage of the liquid crystal display panel, an on-voltage VGH and an off-voltage VGL of the TFT, and a power voltage VCC of the data and gate driving circuits and the timing controller.

The power supply device of the liquid crystal display is integrated into one integrated circuit (IC). An IC, in which the power supply device is embedded, is called a power IC below. When a power switch of the liquid crystal display is switched on, an input voltage Vin of the power IC rises.

The power IC of the liquid crystal display has a under voltage lock out (UVLO) function. When the input voltage Vin of the power IC reaches a previously determined level of the UVLO, the power IC generates an inner logic voltage VL and enables an inner logic. The power IC generates an output voltage Vout when the inner logic is enabled.

The gate driving circuit of the liquid crystal display includes a level shifter and a shift register. With the development of a gate-in panel (GIP) process technology, the shift register may be formed on a substrate, on which a TFT array of the liquid crystal display panel is formed, along with the TFT array. The level shifter may be formed on a printed circuit board (PCB) electrically connected to the substrate of the liquid crystal display panel. The level shifter outputs clock signals swinging between the gate high voltage VGH and the gate low voltage VGL under the control of the timing controller. The gate high voltage VGH is set to a voltage equal to or greater than a threshold voltage of the TFTs included in the TFT array of the liquid crystal display panel. The gate low voltage VGL is set to a voltage less than the threshold voltage of the TFTs included in the TFT array of the liquid crystal display panel. The shift register sequentially shifts the clock signals received from the level shifter and sequentially supplies the gate pulse to the gate lines of the liquid crystal display panel.

As shown in FIG. 1, the level shifter includes a logic circuit 50, a pull-up transistor PT, a pull-down transistor NT, etc. The pull-up transistor PT may be implemented as a p-type metal oxide semiconductor field-effect transistor (MOSFET), and the pull-down transistor NT may be implemented as an n-type MOSFET.

According to a power-on sequence, the gate low voltage VGL is supplied to the level shifter, and the gate high voltage VGH is supplied to the level shifter after a time of several milliseconds (msec) passed. In the process of the power-on sequence, when the gate high voltage VGH supplied to the level shifter reaches a predetermined level of the UVLO, the logic circuit 50 of the level shifter is enabled and starts to operate. When the logic circuit 50 is enabled and starts to normally operate after the power-on sequence, the logic circuit 50 generates an output for controlling on-operations and off-operations of the pull-up transistor PT and the pull-down transistor NT in response to the clock signals received from the timing controller. The pull-up transistor PT supplies the gate high voltage VGH to an output terminal in response to a first output of the logic circuit 50 and rises a clock signal CLK. The pull-down transistor NT discharges an output terminal to the gate low voltage VGL in response to a second output of the logic circuit 50 and falls the clock signal CLK.

When the power switch of the liquid crystal display is switched on, the power IC sequentially outputs the gate low voltage VGL and the gate high voltage VGH in conformity with the previously determined power-on sequence. When the gate high voltage VGH rises to a voltage equal to or greater than the predetermined level of the UVLO, the level shifter is enabled and may stably generate a normal output.

In the process of the power-on sequence, before the gate high voltage VGH is input to the level shifter, the output of the logic circuit 50 is floated. Hence, a gate voltage of the pull-up transistor PT and a gate voltage of the pull-down transistor NT may unstably swing in the process of the power-on sequence. In this instance, as shown in FIG. 2, before the gate high voltage VGH is supplied to the level shifter, the output CLK of the level shifter unstably swings. The unstable output of the level shifter may temporarily lead to erroneous operations of the shift register and the pixels of the liquid crystal display panel in an initial state where the liquid crystal display is just powered on.

SUMMARY OF THE INVENTION

Embodiments of the invention provide a level shifter for a liquid crystal display capable of preventing an erroneous operation of the liquid crystal display in the process of a power-on sequence.

In one aspect, there is a level shifter for a liquid crystal display, which includes a display panel including data lines, gate lines crossing the data lines, and pixels arranged in a matrix form, the level shifter outputting a start pulse and clock signals, a shift register sequentially supplying a gate pulse to the gate lines in response to the start pulse and the clock signals received from the level shifter, and a power integrated circuit (IC) sequentially outputting a gate low voltage, a logic power voltage, and a gate high voltage in the process of a power-on sequence, the level shifter comprising a pull-down transistor including a source terminal, to which the gate low voltage is supplied, and a drain terminal connected to an output terminal of the level shifter, the pull-down transistor discharging a voltage of the output terminal of the level shifter, and an output stabilization circuit which is connected to a gate terminal of the pull-down transistor, controls a gate voltage of the pull-down transistor in the process of the power-on sequence, and discharges an output voltage of the level shifter.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
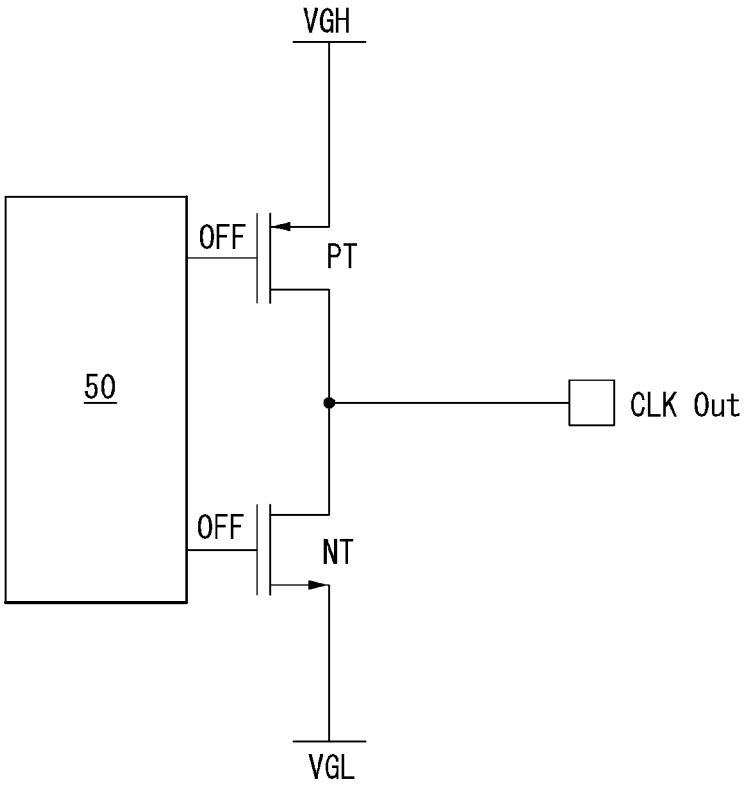
FIG. 1 (RELATED ART)
FIG. 1 is a circuit diagram of a related art level shifter.
Figure 2:
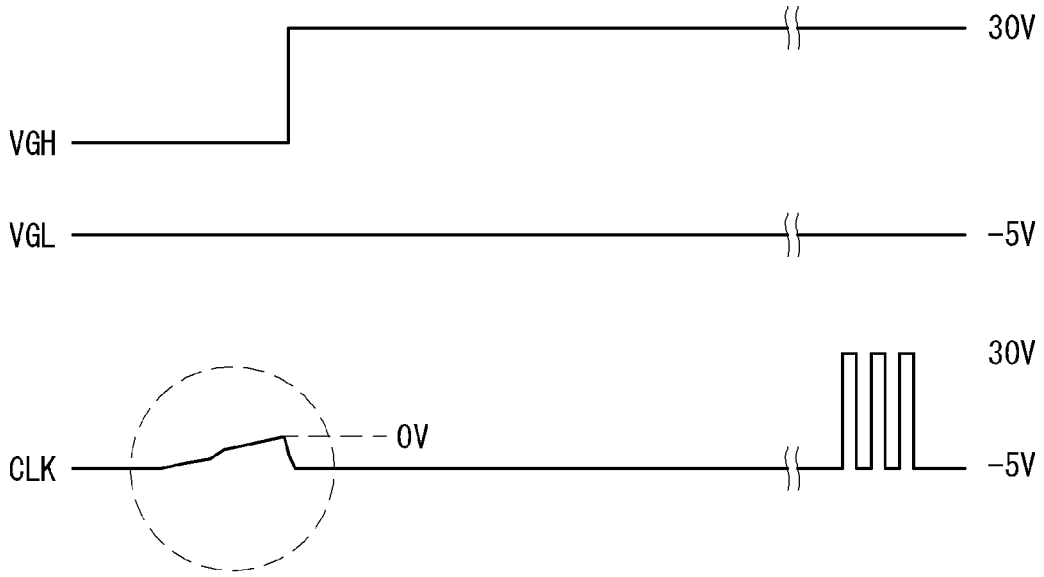
FIG. 2 (RELATED ART)
FIG. 2 is a waveform diagram showing a phenomenon in which an output of a level shifter shown in FIG. 1 is unstable before a gate high voltage is supplied to the level shifter.

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

A liquid crystal display according to an example embodiment of the invention may be implemented as any type liquid crystal display including a transmissive liquid crystal display, a transflective liquid crystal display, and a reflective liquid crystal display. The transmissive liquid crystal display and the transflective liquid crystal display require a backlight unit which is omitted in the drawings. A vertical electric field driving manner such as a twisted nematic (TN) mode and a vertical alignment (VA) mode or a horizontal electric field driving manner such as an in-plane switching (IPS) mode and a fringe field switching (FFS) mode may be applied to the embodiment of the invention. All of liquid crystal modes, which are currently known, may be applied to the embodiment of the invention.

Figure 3:
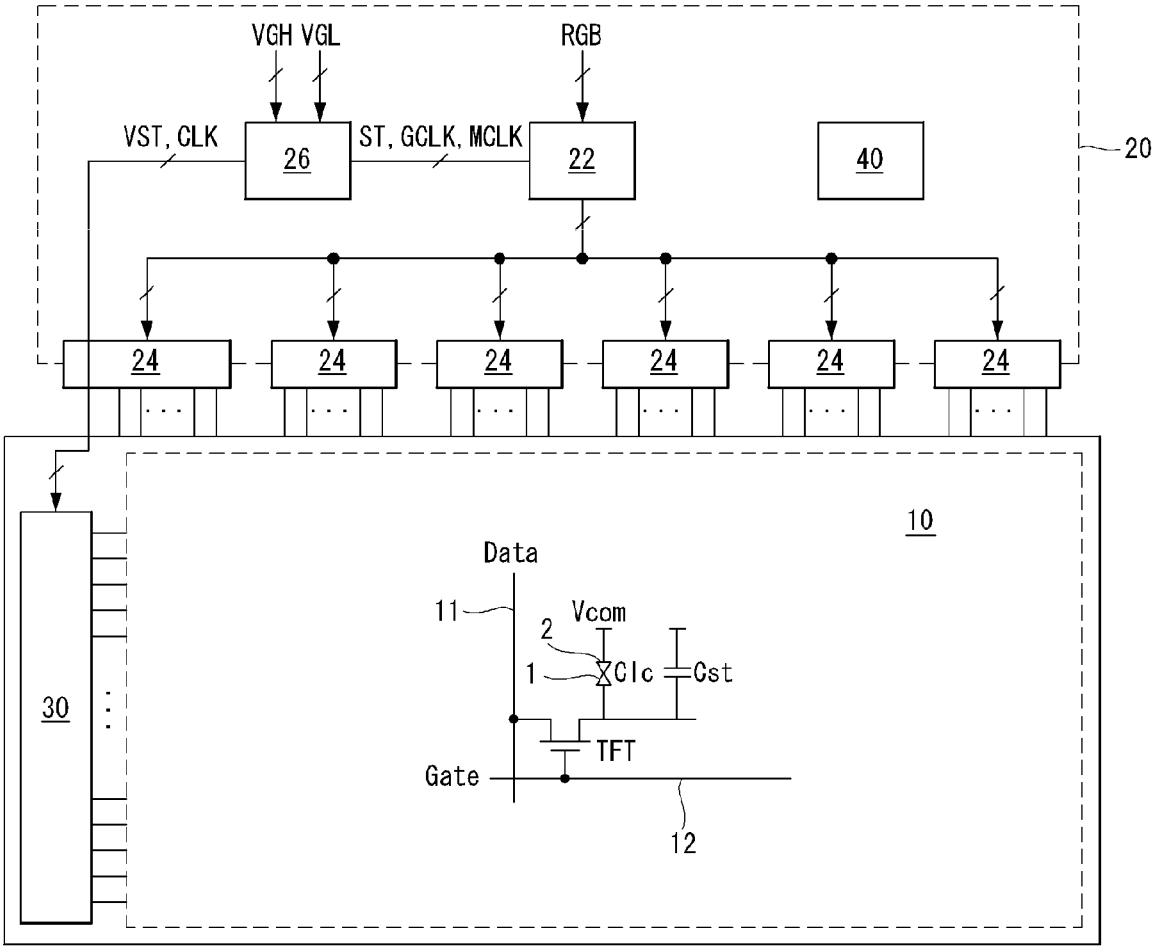
FIG. 3 is a block diagram of a liquid crystal display according to an example embodiment of the invention.

As shown in FIG. 3, the liquid crystal display according to the embodiment of the invention includes a display panel 10, a data driving circuit, a gate-in panel (GIP) type gate driving circuit, a timing controller 22, etc.

The display panel 10 includes a pixel array including pixels arranged in a matrix form and displays input image data. The pixel array includes a thin film transistor (TFT) array formed on a lower substrate of the display panel 10, a color filter array formed on an upper substrate of the display panel 10, and liquid crystal cells Clc formed between the lower substrate and the upper substrate. The TFT array includes data lines 11, gate lines (or scan lines) 12 crossing the data lines 11, TFTs which are respectively formed at crossings of the data lines 11 and the gate lines 12, pixel electrodes 1 connected to the TFTs, storage capacitors Cst, etc. The color filter array includes black matrixes and color filters. Common electrodes 2 may be formed on the lower substrate or the upper substrate of the display panel 10. The liquid crystal cells Clc are driven by an electric field between the pixel electrodes 1, to which a data voltage is supplied, and the common electrodes 2, to which a common voltage Vcom is supplied.

Polarizing plates, of which optical axes are perpendicular to each other, are respectively attached to the upper and lower substrates of the display panel 10. Alignment layers for setting a pre-tilt angle of liquid crystals at an interface contacting a liquid crystal layer are respectively formed on the upper and lower substrates of the display panel 10. A spacer is disposed between the upper substrate and the lower substrate of the display panel 10 to keep a cell gap of the liquid crystal layer constant.

The data driving circuit includes a plurality of source drive integrated circuits (ICs) 24. The source drive ICs 24 receive digital video data RGB from the timing controller 22. The source drive ICs 24 convert the digital video data RGB into positive and negative analog data voltages in response to a source timing control signal received from the timing controller 22. The source drive ICs 24 then supply the data voltages to the data lines 11 of the display panel 10, so that the data voltages are synchronized with a gate pulse (or scan pulse). The source drive ICs 24 may be connected to the data lines 11 of the display panel 10 through a chip-on glass (COG) process or a tape automated bonding (TAB) process. FIG. 3 shows the source drive ICs 24 mounted on a tape carrier package (TCP). A printed circuit board (PCB) 20 is connected to the lower substrate of the display panel 10 via the TCP.

The GIP type gate driving circuit includes a level shifter 26 mounted on the PCB 20 and a shift register 30 formed on the lower substrate of the display panel 10.

The timing controller 22, the level shifter 26, and a power IC 40 are mounted on the PCB 20.

The level shifter 26 receives a start pulse ST, a first clock GCLK, a second clock MCLK, etc. from the timing controller 22. Further, the level shifter 26 receives a driving voltage including a gate high voltage VGH, a gate low voltage VGL, etc. The start pulse ST, the first clock GCLK, and the second clock MCLK swing between 0V and 3.3V. The gate high voltage VGH is equal to or greater than a threshold voltage of the TFT included in the TFT array of the display panel 10 and is about 30V. The gate low voltage VGL is less than the threshold voltage of the TFT included in the TFT array of the display panel 10 and is about −5V.

Figure 5:
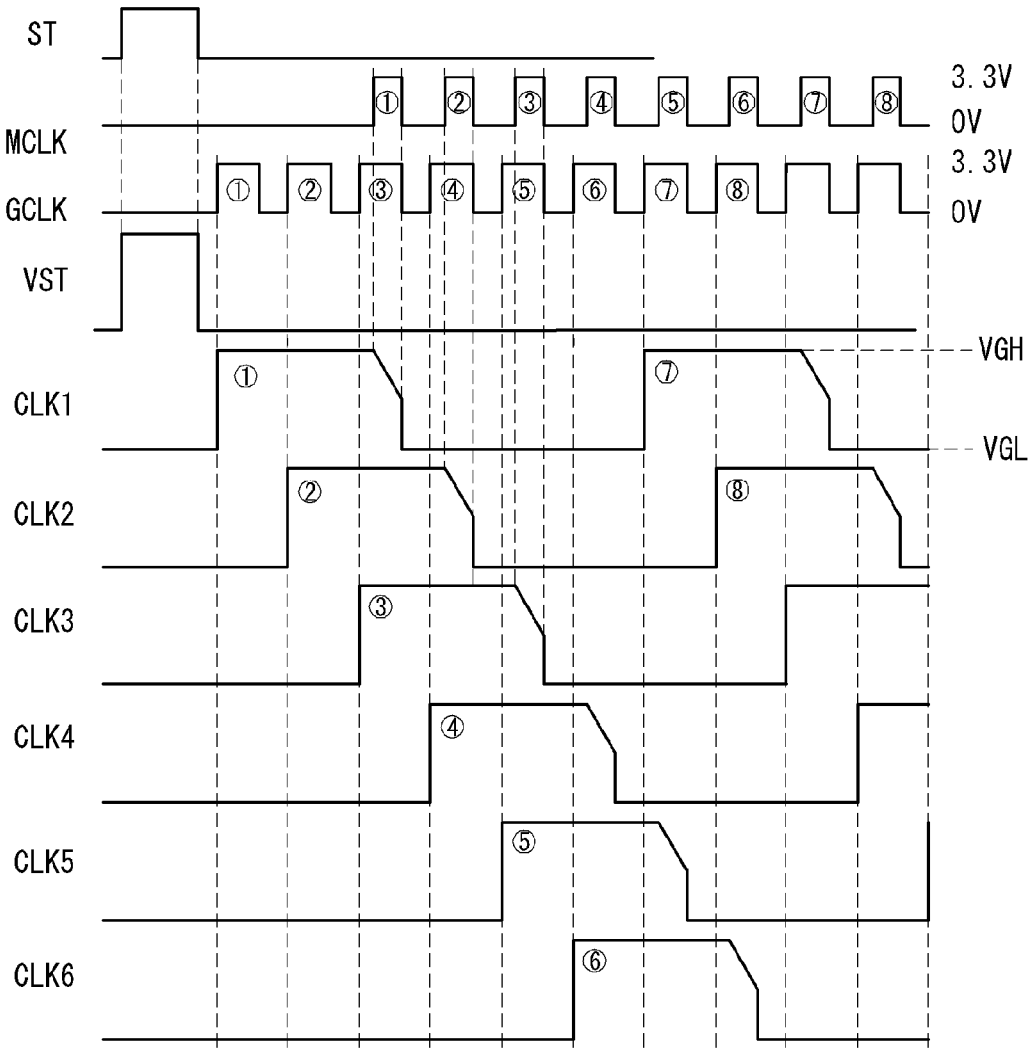
FIG. 5 is a waveform diagram showing input and output signals of a level shifter shown in FIG. 3.

As shown in FIG. 5, the level shifter 26 outputs a start pulse VST and clock signals CLK1 to CLK6, each of which swings between the gate high voltage VGH and the gate low voltage VGL, in response to the start pulse ST, the first clock GCLK, and the second clock MCLK received from the timing controller 22. The clock signals CLK1 to CLK6 output from the level shifter 26 are sequentially phase-shifted and are transmitted to the shift register 30 of the GIP type gate driving circuit.

The shift register 30 is connected to the gate lines 12 of the display panel 10. The shift register 30 includes a plurality of cascade-connected stages. The shift register 30 shifts the start pulse VST received from the level shifter 26 in response to the clock signals CLK1 to CLK6 and sequentially supplies the gate pulse to the gate lines 12.

The timing controller 22 receives the digital video data RGB and timing signals, such as a vertical sync signal Vsync, a horizontal sync signal Hsync, a data enable signal DE and a main clock CLK, from an external host system (not shown). The timing controller 22 transmits the digital video data RGB to the source drive ICs 24. The timing controller 22 generates the source timing control signal for controlling operation timings of the source drive ICs 24 and gate timing control signals ST, GCLK and MCLK for controlling operation timings of the level shifter 26 and the shift register 30 of the GIP type gate driving circuit using the timing signals Vsync, Hsync, DE and CLK.

The power IC 40 starts to operate when an input voltage Vin of the power IC 40 received from the host system is equal to or greater than a predetermined level of under voltage lock out (UVLO), and generates an output after a predetermined time passed. The output of the power IC 40 includes VGH, VGL, VCC, VDD, HVDD, RST, etc. VCC is a logic power voltage for driving the timing controller 22 and the source drive ICs 24 and may be about 3.3V. VDD and HVDD are a high potential power voltage and a half high potential power voltage which will be supplied to a voltage divider of a gamma reference voltage generating circuit for generating positive and negative gamma reference voltages. The positive and negative gamma reference voltages are supplied to the source drive ICs 24. RST is a reset signal for resetting the timing controller 22 and may be about 3.3V.

Figure 4:
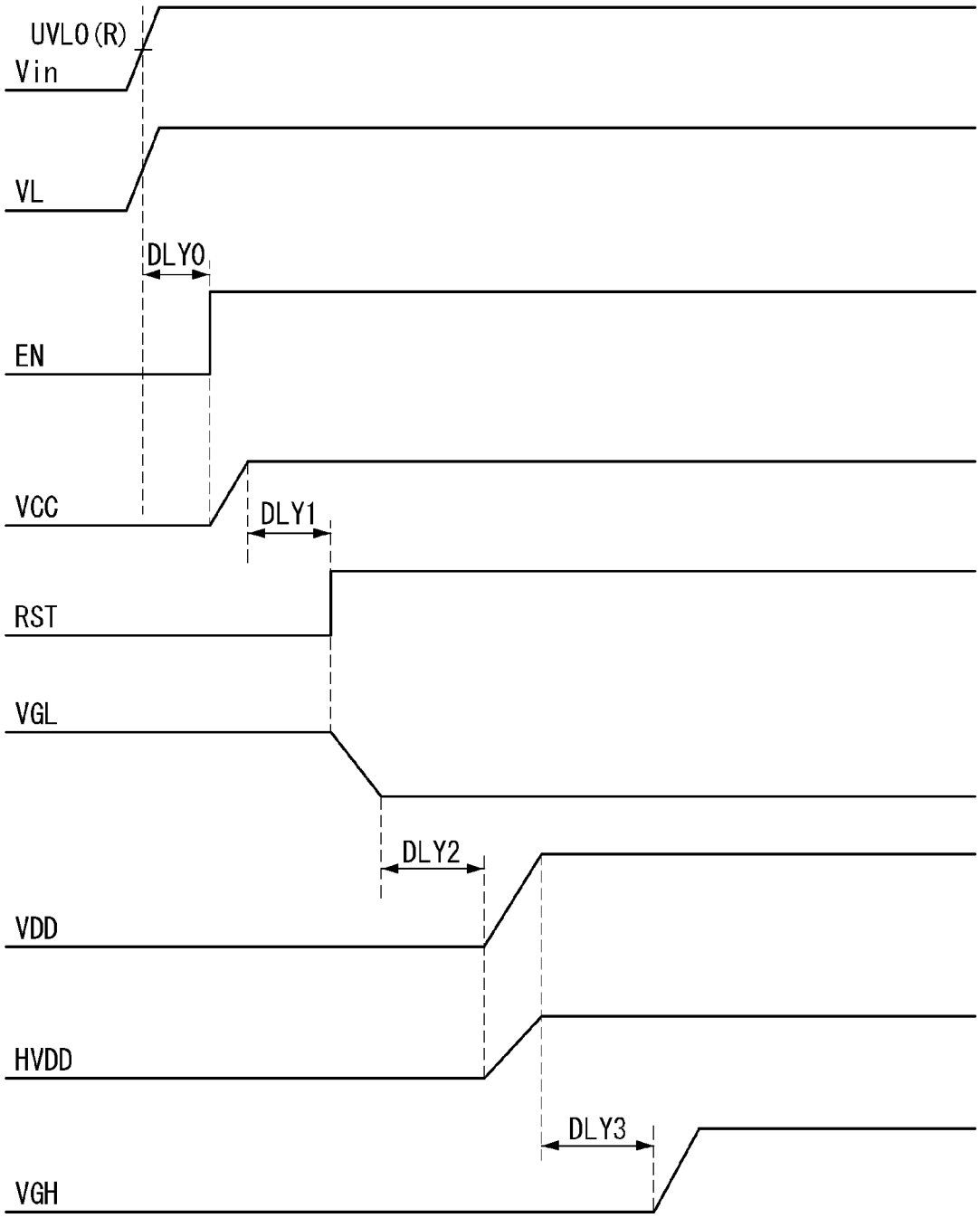
FIG. 4 is a waveform diagram showing input and output signals in a power IC shown in FIG. 3.

As shown in FIG. 4, the power IC 40 sequentially outputs the driving voltages of the liquid crystal display in conformity with a previously determined power-on sequence. More specifically, the power IC 40 starts to operate when its input voltage Vin rises and thus reaches the predetermined level of the UVLO, and generates an enable signal EN after a first delay time DLY0 passed. Next, the power IC 40 generates the logic power voltage VCC subsequent to the enable signal EN and outputs the reset signal RST after a second delay time DLY1 passed. Next, the power IC 40 generates the gate low voltage VGL subsequent to the reset signal RST and generates the high potential power voltage VDD and the half high potential power voltage HVDD subsequent to the gate low voltage VGL after a third delay time DLY2 passed. Next, the power IC 40 generates the gate high voltage VGH subsequent to the high potential power voltage VDD and the half high potential power voltage HVDD after a fourth delay time DLY3 passed.

Figure 6:
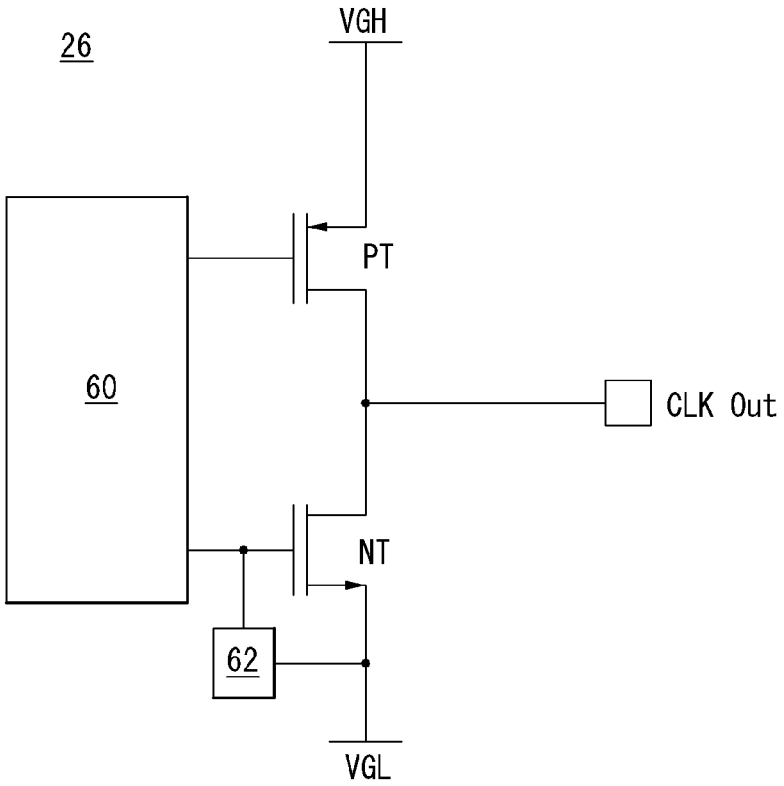
FIG. 6 is a block diagram showing a configuration of a level shifter according to an example embodiment of the invention.
Figure 7:
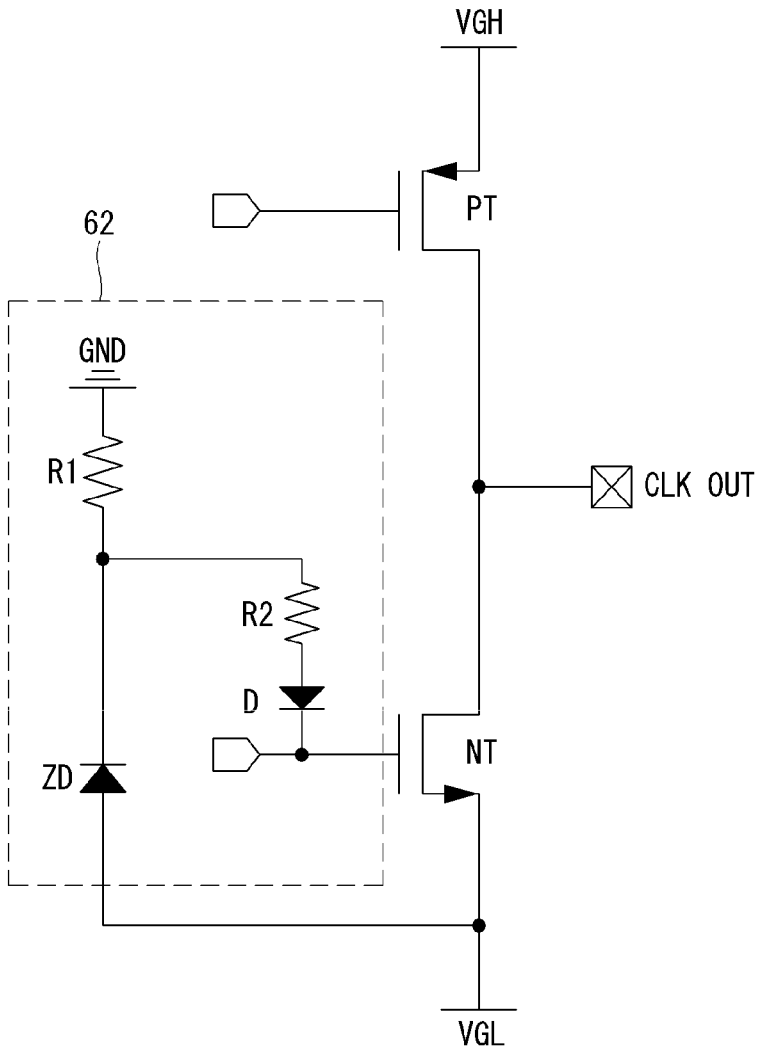
FIG. 7 is a circuit diagram showing in detail an output stabilization circuit shown in FIG. 6.

FIG. 5 is a waveform diagram showing input and output signals of the level shifter 26. FIG. 6 is a block diagram showing a first configuration example of the level shifter 26. FIG. 7 is a circuit diagram showing in detail an output stabilization circuit shown in FIG. 6.

As shown in FIGS. 5 to 7, the level shifter 26 includes a logic circuit 60, a pull-up transistor PT, a pull-down transistor NT, an output stabilization circuit 62, etc. The pull-up transistor PT may be implemented as a p-type metal oxide semiconductor field-effect transistor (MOSFET), and the pull-down transistor NT may be implemented as an n-type MOSFET.

According to the power-on sequence, the gate low voltage VGL is supplied to the level shifter 26, and the gate high voltage VGH is supplied to the level shifter 26 after a time of several milliseconds (msec) passed. In the process of the power-on sequence, when the gate high voltage VGH supplied to the level shifter 26 reaches the predetermined level of the UVLO, the logic circuit 60 of the level shifter 26 is enabled and starts to operate. When the logic circuit 60 is enabled and starts to normally operate after the power-on sequence, the logic circuit 60 generates an output for controlling on-operations and off-operations of the pull-up transistor PT and the pull-down transistor NT in response to the clock signals VST, MCLK and GCLK received from the timing controller 22.

The pull-up transistor PT includes a source terminal to which the gate high voltage VGH is supplied, a drain terminal connected to an output terminal of the level shifter 26, and a gate terminal connected to a first output terminal of the logic circuit 60. The pull-up transistor PT supplies the gate high voltage VGH to the output terminal of the level shifter 26 in response to a first output of the logic circuit 60 and rises the clock signal CLK.

The pull-down transistor NT includes a source terminal to which the gate low voltage VGL is supplied, a drain terminal connected to the output terminal of the level shifter 26, and a gate terminal connected to a second output terminal of the logic circuit 60. The pull-down transistor NT discharges the output terminal of the level shifter 26 to the gate low voltage VGL in response to a second output of the logic circuit 60 and falls the clock signal CLK.

The level shifter 26 starts to normally operate after the power-on sequence and level-shifts a voltage of the start pulse ST to a voltage, which swings between the gate low voltage VGL and the gate high voltage VGH, thereby outputting the start pulse VST. The level shifter 26 rises the clock signals CLK1 to CLK6 to be supplied to the shift register 30 when the first clock GCLK rises, and shifts the clock signals CLK1 to CLK6 each time the first clock GCLK is input. Each of the clock signals CLK1 to CLK6 swings between the gate low voltage VGL and the gate high voltage VGH. The level shifter 26 starts to reduce the gate high voltage VGH in synchronization with a rising edge of the second clock MCLK and increases the gate high voltage VGH to an original voltage in synchronization with a falling edge of the second clock MCLK. Hence, a difference between the gate low voltage VGL and the gate high voltage VGH decreases around falling edges of the clock signals CLK1 to CLK6. As a result, a reduction in voltage differences between the clock signals CLK1 to CLK6 reduces a kickback voltage $\Delta Vp$ of the liquid crystal cells, thereby reducing a flicker.

The output stabilization circuit 62 increases a gate voltage of the pull-down transistor NT, so as to stabilize an output of the level shifter 26 before the gate high voltage VGH is input to the level shifter 26 in the process of the power-on sequence. The pull-down transistor NT is turned on depending on the gate voltage increased by the output stabilization circuit 62 in the process of the power-on sequence, to thereby discharge the output voltage of the level shifter 26 to the gate low voltage VGL.

As shown in FIG. 7, the output stabilization circuit 62 includes first and second diodes ZD and D and first and second resistors R1 and R2. In the process of the power-on sequence, the output stabilization circuit 62 stabilizes the output voltage of the level shifter 26 to the gate low voltage VGL for an initialization time, at which the gate low voltage VGL is supplied to the level shifter 26 and the gate high voltage VGH is not yet supplied to the level shifter 26.

An anode of the first diode ZD is connected to the source terminal of the pull-down transistor NT, and a cathode of the first diode ZD is connected to a node between the first and second resistances R1 and R2. The first diode ZD may be implemented as a zener diode. The first resistor R1 is connected between a ground level voltage source GND (i.e., zero volt) and the cathode of the first diode ZD. The second resistor R2 is connected to an anode of the second diode D and a node between the first resistor R1 and the first diode ZD.

In the process of the power-on sequence, when the gate low voltage VGL is supplied to the level shifter 26 and the gate high voltage VGH is not yet supplied to the level shifter 26, the gate low voltage VGL (for example, −5V) is applied to the cathode of the first diode ZD, and 0V is applied to the anode of the first diode ZD. Hence, the pull-down transistor NT is turned on because a gate-source voltage is greater than a threshold voltage of the pull-down transistor NT. As a result, the output terminal of the level shifter 26 is discharged to the gate low voltage VGL.

The anode of the second diode D is connected to the second resistor R2, and a cathode of the second diode D is connected to the gate terminal of the pull-down transistor NT. The second diode D is turned on only when an anode voltage of the second diode D is greater than a cathode voltage of the second diode D and a difference between the anode voltage and the cathode voltage is equal to or greater than a threshold voltage of the second diode D. The second diode D is maintained in an off-state in the remaining cases. Hence, the second diode D serves as a switching element. Thus, the second diode D blocks a reverse current flowing from the gate terminal of the pull-down transistor NT to the ground level voltage source GND, thereby preventing the voltage of the second output of the logic circuit 60 from being abnormally discharged when the logic circuit 60 normally operates.

Figure 8:
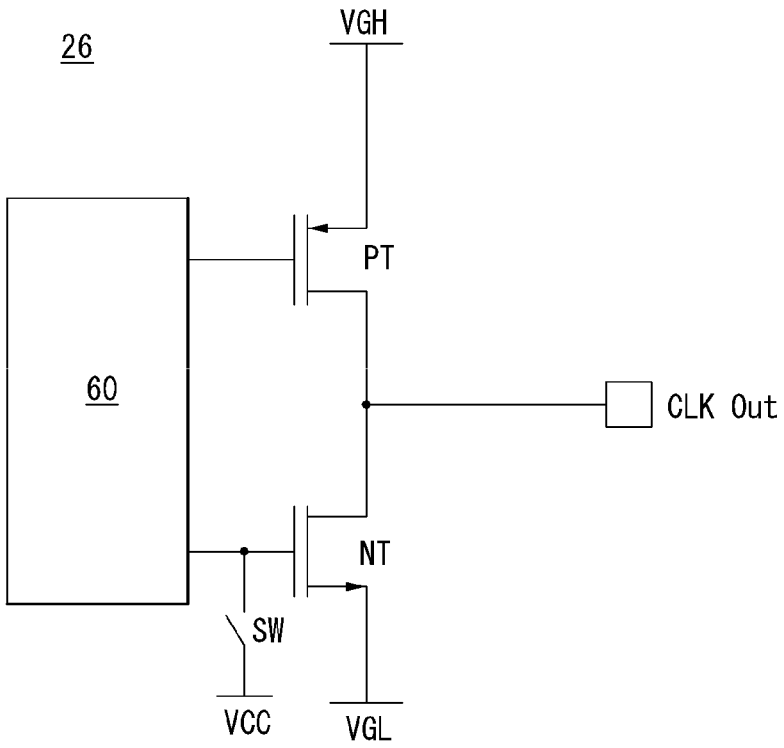
FIG. 8 is a block diagram showing another configuration of a level shifter according to an example embodiment of the invention.

In the process of the power-on sequence, before the gate high voltage VGH is generated, the logic power voltage VCC is generated. As shown in FIG. 8, in the process of the power-on sequence, the output stabilization circuit 62 supplies the logic power voltage VCC to the gate terminal of the pull-down transistor NT through a switch SW using this and may discharge the output voltage of the level shifter 26 to the gate low voltage VGL. The switch SW may be simply implemented as the second diode D shown in FIG. 7. In this instance, the logic power voltage VCC is supplied to an anode of a diode used as the switch SW, and a cathode of the diode is connected to the gate terminal of the pull-down transistor NT.

As described above, the embodiment of the invention connects the pull-down transistor and the output stabilization circuit included in the level shifter to each other. In the process of the power-on sequence, the output stabilization circuit discharges the output voltage of the level shifter for the initialization time, at which the gate low voltage is supplied to the level shifter and the gate high voltage is not yet supplied to the level shifter. As a result, the embodiment of the invention may prevent the erroneous operation of the liquid crystal display in the process of the power-on sequence.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a display panel including data lines, gate lines crossing the data lines, and pixels arranged in a matrix form;

a level shifter outputting a start pulse and clock signals;

a shift register sequentially supplying a gate pulse to the gate lines in response to the start pulse and the clock signals received from the level shifter; and a power integrated circuit (IC) sequentially outputting a gate low voltage, a logic power voltage, and a gate high voltage in the process of a power-on sequence, the level shifter including:

a pull-down transistor configured to include a source terminal, to which the gate low voltage is supplied, and a drain terminal connected to an output terminal of the level shifter, the pull-down transistor discharging a voltage of the output terminal of the level shifter; and an output stabilization circuit configured to be connected to a gate terminal of the pull-down transistor, wherein the output stabilization circuit discharges an output voltage of the level shifter to the gate low voltage by controlling a gate voltage of the pull-down transistor to turn on the pull-down transistor before the gate high voltage is input to the level shifter in the process of the power-on sequence.

2. The liquid crystal display of claim 1, wherein the output stabilization circuit includes:

a first resistor connected to a ground level voltage source;

a first diode connected between the first resistor and the source terminal of the pull-down transistor;

a second resistor connected between a node between the first resistor and the first diode and the gate terminal of the pull-down transistor; and a second diode connected between the second resistor and the gate terminal of the pull-down transistor.

3. The liquid crystal display of claim 2, wherein the first diode includes an anode connected to the source terminal of the pull-down transistor and a cathode connected to a node between the first and second resistors, wherein the second diode includes a cathode connected to the gate terminal of the pull-down transistor and an anode connected to the second resistor.

4. The liquid crystal display of claim 1, wherein the output stabilization circuit includes a switch supplying the logic power voltage to the gate terminal of the pull-down transistor in the process of the power-on sequence.

5. The liquid crystal display of claim 4, wherein the switch of the output stabilization circuit includes a diode having a cathode connected to the gate terminal of the pull-down transistor and an anode connected to a second resistor.

6. The liquid crystal display of claim 1, wherein the level shifter further includes a pull-up transistor having a source terminal, to which the gate high voltage is supplied, and a drain terminal connected to an output terminal of the level shifter, the pull-up transistor supplying the gate high voltage to the output terminal of the level shifter.

7. The liquid crystal display of claim 6, wherein the pull-up transistor is implemented as a p-type metal oxide semiconductor field-effect transistor (MOSFET), and the pull-down transistor is implemented as an n-type MOSFET.

8. The liquid crystal display of claim 1, wherein the output stabilization circuit increases the gate voltage of the pull-down transistor before the gate high voltage is input to the level shifter in the process of the power-on sequence.

9. A liquid crystal display comprising:

a display panel including data lines, gate lines crossing the data lines, and pixels arranged in a matrix form;

a level shifter outputting a start pulse and clock signals;

a shift register sequentially supplying a gate pulse to the gate lines in response to the start pulse and the clock signals received from the level shifter; and a power integrated circuit (IC) sequentially outputting a gate low voltage, a logic power voltage, and a gate high voltage in the process of a power-on sequence, the level shifter including:

a pull-down transistor including a source terminal, to which the gate low voltage is supplied, and a drain terminal connected to an output terminal of the level shifter, the pull-down transistor discharging a voltage of the output terminal of the level shifter; and an output stabilization circuit which is connected to a gate terminal of the pull-down transistor, controls a gate voltage of the pull-down transistor in the process of the power-on sequence, and discharges an output voltage of the level shifter, wherein the output stabilization circuit includes:

a first resistor connected to a ground level voltage source;

a first diode connected between the first resistor and the source terminal of the pull-down transistor;

a second resistor connected between a node between the first resistor and the first diode and the gate terminal of the pull-down transistor; and a second diode connected between the second resistor and the gate terminal of the pull-down transistor.

10. The liquid crystal display of claim 9, wherein the level shifter further includes a pull-up transistor having a source terminal, to which the gate high voltage is supplied, and a drain terminal connected to an output terminal of the level shifter, the pull-up transistor supplying the gate high voltage to the output terminal of the level shifter.

11. The liquid crystal display of claim 10, wherein the pull-up transistor is implemented as a p-type metal oxide semiconductor field-effect transistor (MOSFET), and the pull-down transistor is implemented as an n-type MOSFET.

12. The liquid crystal display of claim 9, wherein the output stabilization circuit increases the gate voltage of the pull-down transistor before the gate high voltage is input to the level shifter in the process of the power-on sequence.

13. A liquid crystal display comprising:

a display panel including data lines, gate lines crossing the data lines, and pixels arranged in a matrix form;

a level shifter outputting a start pulse and clock signals;

a shift register sequentially supplying a gate pulse to the gate lines in response to the start pulse and the clock signals received from the level shifter; and a power integrated circuit (IC) sequentially outputting a gate low voltage, a logic power voltage, and a gate high voltage in the process of a power-on sequence, the level shifter including:

a pull-down transistor including a source terminal, to which the gate low voltage is supplied, and a drain terminal connected to an output terminal of the level shifter, the pull-down transistor discharging a voltage of the output terminal of the level shifter; and an output stabilization circuit which is connected to a gate terminal of the pull-down transistor, controls a gate voltage of the pull-down transistor in the process of the power-on sequence, and discharges an output voltage of the level shifter, wherein the output stabilization circuit includes:

a first resistor connected to a ground level voltage source;

a first diode connected between the first resistor and the source terminal of the pull-down transistor;

a second resistor connected between a node between the first resistor and the first diode and the gate terminal of the pull-down transistor; and a second diode connected between the second resistor and the gate terminal of the pull-down transistor, wherein the first diode includes an anode connected to the source terminal of the pull-down transistor and a cathode connected to a node between the first and second resistors, and wherein the second diode includes a cathode connected to the gate terminal of the pull-down transistor and an anode connected to the second resistor.

14. The liquid crystal display of claim 13, wherein the level shifter further includes a pull-up transistor having a source terminal, to which the gate high voltage is supplied, and a drain terminal connected to an output terminal of the level shifter, the pull-up transistor supplying the gate high voltage to the output terminal of the level shifter.

15. The liquid crystal display of claim 14, wherein the pull-up transistor is implemented as a p-type metal oxide semiconductor field-effect transistor (MOSFET), and the pull-down transistor is implemented as an n-type MOSFET.

16. The liquid crystal display of claim 13, wherein the output stabilization circuit increases the gate voltage of the pull-down transistor before the gate high voltage is input to the level shifter in the process of the power-on sequence.

* * * * *